United States Patent [19]

Hofmann

[11] Patent Number: 4,713,942

[45] Date of Patent: Dec. 22, 1987

[54] METHOD FOR COOLING AN OBJECT WITH THE AID OF SUPERFLUID HELIUM (HE II) AND APPARATUS FOR IMPLEMENTING THE METHOD

[75] Inventor: Albert Hofmann, Karlsruhe, Fed. Rep. of Germany

[73] Assignee: Kernforschungszentrum Karlsruhe GmbH, Karlsruhe, Fed. Rep. of Germany

[21] Appl. No.: 900,912

[22] Filed: Aug. 15, 1986

[30] Foreign Application Priority Data

Aug. 16, 1985 [DE] Fed. Rep. of Germany ..... 3529391

[51] Int. Cl.[4] ..... F25D 25/00

[52] U.S. Cl. ..... 62/62; 62/514 R

[58] Field of Search ..... 62/514 R, 62

[56] References Cited

U.S. PATENT DOCUMENTS

| | | | |
|---|---|---|---|
| 4,136,526 | 1/1979 | Chanin et al. | 62/514 R |
| 4,136,531 | 1/1979 | Staas et al. | 62/514 R |
| 4,296,609 | 10/1981 | Severijns et al. | 62/514 R |
| 4,297,856 | 11/1981 | Staas et al. | 62/514 R |
| 4,300,360 | 11/1981 | Chanin et al. | 62/514 R |
| 4,459,828 | 7/1984 | Rosenbaum | 62/514 R |
| 4,499,737 | 2/1985 | Binnig et al. | 62/514 R |

*Primary Examiner*—Ronald C. Capossela

*Attorney, Agent, or Firm*—Spencer & Frank

[57] ABSTRACT

A method for cooling an object with the aid of superfluid helium (He II) in which a fountain effect pump is used to produce a forced flow of He II and to an apparatus for implementing the method. The abnormally good thermal conductivity of He II in a temperature range between 1.7° K. and 2.1° K. and its superfluidity are excellent characteristics for cooling superconductive magnetic coils. In the past, such 1.8° K. cooled coils could be attained only by external cooling according to the bath cooling principle. Internal cooling of the conductors with forced flow, as practiced already with He I cooling systems, could not yet be realized for operation with He II due to the lack of suitable pumping systems. In the process of the invention, the heat absorbed by the object to be cooled is utilized in an advantageous manner to generate the forced flow of Helium (He II) in its own cooling circuit, with the absorbed heat being coupled into a thermomechanical pump in such a manner that no additional driving power is required and the flow rate automatically adjusts itself to the respective load.

11 Claims, 10 Drawing Figures

METHOD FOR COOLING AN OBJECT WITH THE AID OF SUPERFLUID HELIUM (HE II) AND APPARATUS FOR IMPLEMENTING THE METHOD

BACKGROUND OF THE INVENTION

1. Field of the Invention

The present invention relates to a method for cooling an object with the aid of superfluid helium (He II) and to an apparatus for implementing the method.

2. Description of the Background

The abnormally good thermal conductivity of He II in a temperature range between 1.7° K. and 2.1° K. and its superfluidity are characteristics which make He II an excellent choice for cooling superconductive magnetic coils. In the past, 1.8° K. cooled coils could be attained only by external cooling with bath cooled coils. This conventional technique is known to have a variety of drawbacks. Amongst these can be cited that it requires a tight coil housing, the conductor is poorly fixed mechanically and it has poor high voltage strength.

These drawbacks can be overcome by changing from such external bath cooling system wherein the conductor is cooled externally to an internal conductor cooling system operated by a forced flow of helium. Up to the present time, and due to the lack of suitable pumps, it had not been possible to implement this concept for cooling with superfluid helium (He II).

Fountain effect pumps (FEP) have been known which generate convection of He II in 3He-4He cooling machines as disclosed in Dutch Patent Applicaton No. 79/02438 (published without examination).

In all known uses, the pumping effect is produced by additionally heating the warm end of a superfilter. The degree of thermomechanical efficiency of such pumps is very low (less than 10% of the heat supplied can be converted to energy). Thus, this method results in an uneconomic, high load on the refrigeration system, particularly if the helium circulation rate is high.

Accordingly, there still is a need for a more efficient method of cooling a subtrate and an apparatus thereof. Both are provided hereinbelow.

SUMMARY OF THE INVENTION

The invention provides a more efficient and economical way of cooling with liquid helium useful for objects such as large superconductive magnets.

In one aspect of the invention, it is provided a method for cooling an object comprising internally cooling the substrate with superfluid helium (He II) at a temperature between about 1.7° K. and 2.1° K. with a forced flow of He II, wherein thermal energy obtained from the heat to be removed from the substrate being cooled is transferred to the superfluid helium flow and, thereafter, utilized to force by means of a fountain-effect pump the current of superfluid helium through the substrate. The present method further comprises removing the heat transferred from the substrate to the outgoing helium, thereby re-cooling the helium, and incorporating the re-cooled helium into the helium flow forced into the substrate; and utilizing the thus obtained thermal energy to force the flow of superfluid helium through the substrate.

In another aspect of this invention, it is provided herein an apparatus for cooling a substrate, comprising a means containing a closed helium II circuit comprising first, second and third heat-exchangers being in flow communication with one another;

a helium II heating bath of a fountain-effect pump, a helium II re-cooling bath having an inlet, a vessel containing helium, a pressure equalizing conduit, a helium II supply bath, and a superfilter of a FEP;

said first heat-exchanger being positioned in the re-cooling bath and connected to an inlet of a cooling conduit of the substrate to be cooled;

said second heat-exchanger being positioned in the heating bath of the FEP and having its inlet connected to an outlet of the cooling conduit of the substrate to be cooled;

said third heat-exchanger being positioned in the re-cooling bath and having an inlet of said third heat-exchanger connected to an outlet of the second heat-exchanger and an outlet of said third heat-exchanger opened up into the supply bath which is in flow communication with, and supplies helium II to, the superfilter of the FEP; and said vessel containing helium and said helium supply bath being in flow communication by means of the pressure equalizing conduit.

Other objects, advantages and features of the present invention will become apparent to those skilled in the art from the following discussion.

DESCRIPTION OF THE PREFERRED EMBODIMENTS

One particular advantage of the invention is that the heat dissipated by the object to be cooled is utilized to generate the forced flow in the object's own cooling circuit, with the lost heat being coupled into a pump in such a manner that no additional driving power is required and the flow rate adjusts itself automatically to the respective load. In a very advantageous manner, these pumps have no mechanically movable parts.

The invention provides an opportunity to attain internally cooled conductor designs at extremely low temperatures below the λ line of liquid helium, i.e. with superfluid helium (He II). The undeniable advantages inherent thereto, of cooling by means of a forced flow, are combined with the advantages of the extremely good cooling characteristics of He II for the construction of large superconductive coils.

The inevitable increase in cost accompanying the greater cooling power required to go down to 1.8° K. compared to the customary cooling at temperatures around 4° K. can often be compensated by using less expensive materials (NbTi instead of $Nb_3Sn$) and by the higher magnetic field and current densities that can be attained at 1.8° K.

A more complete appreciation of the invention and many of the attendant advantages thereof will be readily perceived as the same becomes better understood by reference to the following detailed description when considered in connection with the accompanying Figures. Several embodiments of the invention will be described hereinbelow with reference to FIGS. 1 to 6.

DESCRIPTION OF THE PREFERRED EMBODIMENTS IN REFERENCE TO THE DRAWINGS

Figure 1:
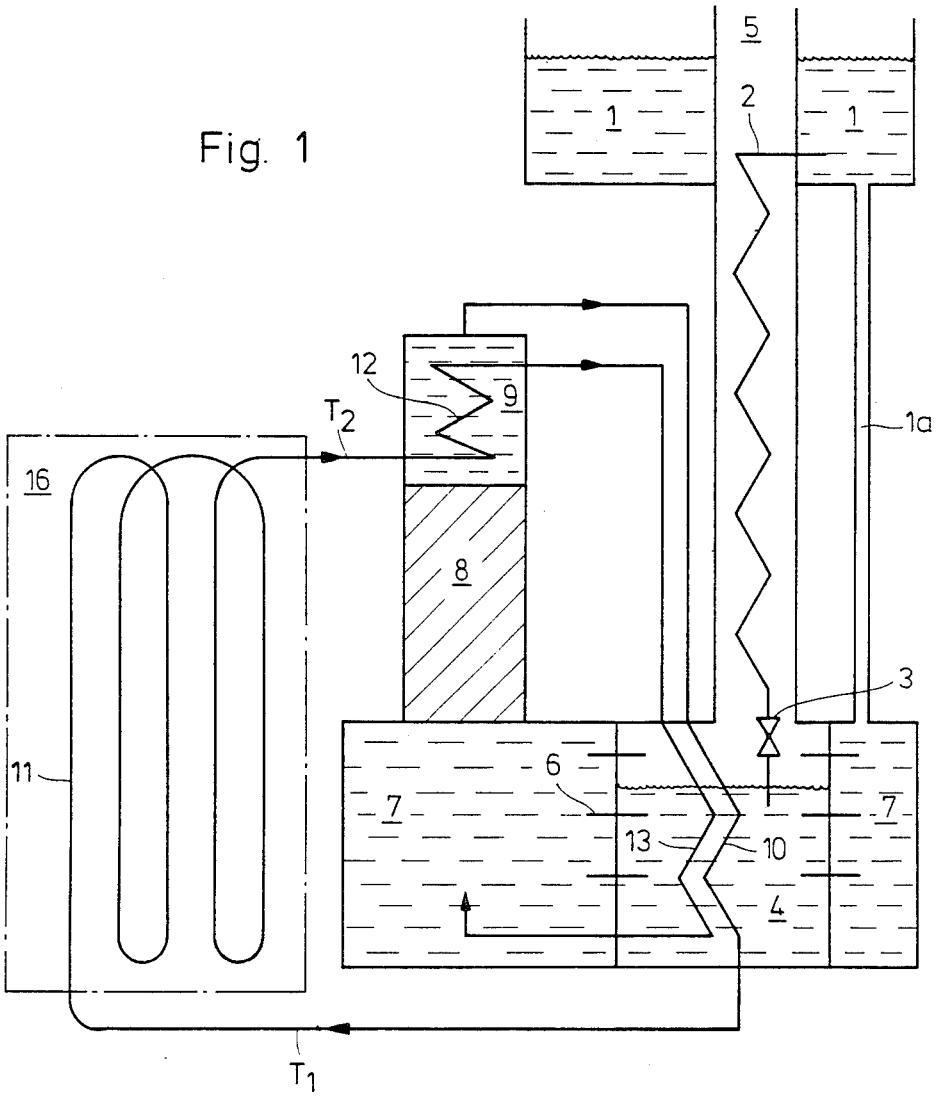
FIG. 1 is a schematic representation of the cooling circuit according to the invention.

FIG. 1 is a schematic representation of the cooling circuit. The drawing also includes a prior art cooling system which is able to produce the 1.8° K. operating temperature as a reference. Liquid helium boiling in a reservoir vessel 1 at a pressure of, for example, 1 bar, is conducted through a pipe 2 serving as heat-exchanger and to a pressure reduction valve 3. By reduction to a pressure of about 15 mbar, an operating temperature of about 1.8° K. is attained in a re-cooling bath 4. The vapor is extracted through conduit 5 and returned to the liquefier. The re-cooling bath 4 is disposed above a wall 6 designed as a heat-exchanger and is in good thermal contact with a supply bath 7 which, through a pressure equalization conduit 1*a*, takes on the same pressure as reservoir vessel 1. Thus, subcooled He II at a temperature of 1.8° K. is present in supply bath 7 at a pressure of, for example, 1 bar, the same as in reservoir vessel 1. Pressure equalization conduit 1*a* should be designed as a so-called thermal barrier to reduce the flow of heat from reservoir vessel 1 to supply bath 7 to a permissible amount.

The superfluid helium (He II) from supply bath 7 is conducted, by means of a thermomechanical pump (fountain effect pump) composed of a finely porous filter 8 (superfilter) connected upstream of a heating bath 9, and after being re-cooled in a first heat-exchanger 10 to the temperature of re-cooling bath 4, into a cooling channel 11 in the object 16 to be cooled, for example, a superconductive coil. On this cooling path 11, the He II absorbs the heat dissipated therefrom. Upon exiting, the heated He flows through a second heat-exchanger 12 in which it gives part of the absorbed heat to heating bath 9.

Due to the thermomechanical effect (a specific effect occurring in He II), superfluid He flows substantially without dissipation from supply bath 7 to heating bath 9 provided that heating bath 9 is at a higher temperature than supply bath 7. This is effected by coupling the heat absorbed in cooling path 11 into the heating bath 9 of the fountain effect pump.

Superfilter 8 acts as an entropy filter. Figuratively speaking, when the He II flows through this filter, its heat is stripped away. The result is that heat is produced by a flow in supply bath 7 and heat-exchanger 6 returns this heat to re-cooling bath 4. However, at the exit of superfilter 8 there occurs a cooling effect. Thus, part of the heat supplied to heating bath 9 by heat-exchanger 12 is removed. The helium exiting from the second heat-exchanger 12 is then re-cooled to its starting temperature in a third heat-exchanger 13 connected downstream and is returned to supply bath 7.

Figure 1A:
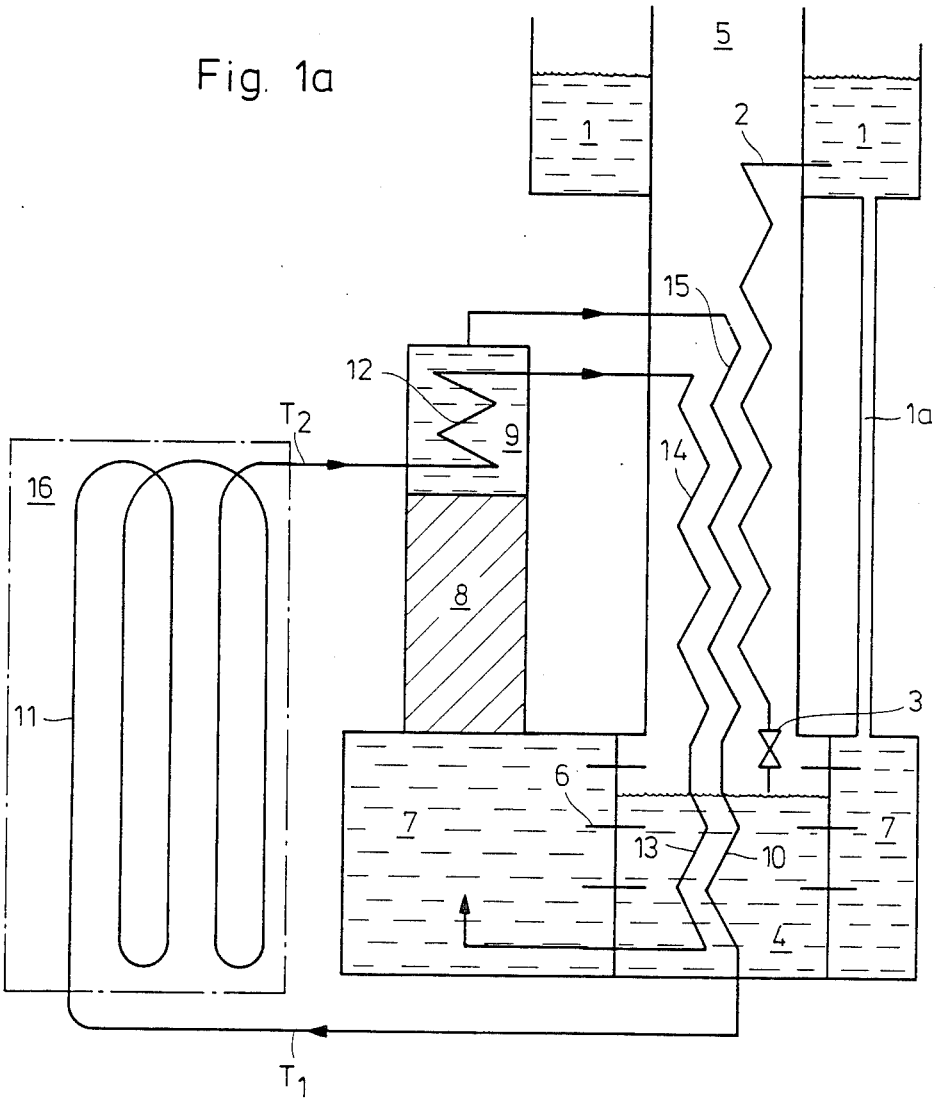
FIG. 1*a* is an expanded version of the cooling circuit according to FIG. 1.

FIG. 1*a* shows an expanded version of the device of FIG. 1 in which a fourth heat-exchanger 14 and a fifth heat-exchanger 15 are connected upstream of heat-exchangers 10 and 13 so as to produce preliminary cooling within exhaust gas conduit 5 and thus reduce the heat load on re-cooling bath 4.

Figure 2:
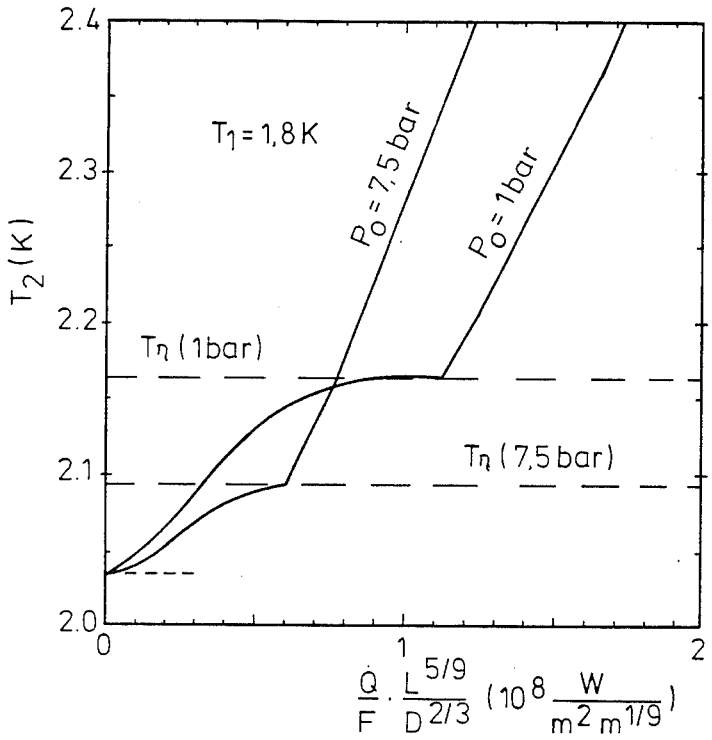
FIG. 2 shows the exit temperature $T_2$ as a function of the standardized load at various system pressures $p_o$. The entrance temperature is $T_1 = 1.8°$ K.

FIG. 2 shows the calculated cooling characteristics of the cooling system according to the invention. The fluid temperature $T_2$ upon leaving cooling channel 11, which is heated with power Q and has a length L, a flow cross-section F and a hydraulic diameter D, is plotted against the "standardized" heating power. The calculation has been made for two different system pressures ($p_o = 1.0$ and 7.5 bar).

Figure 2A:
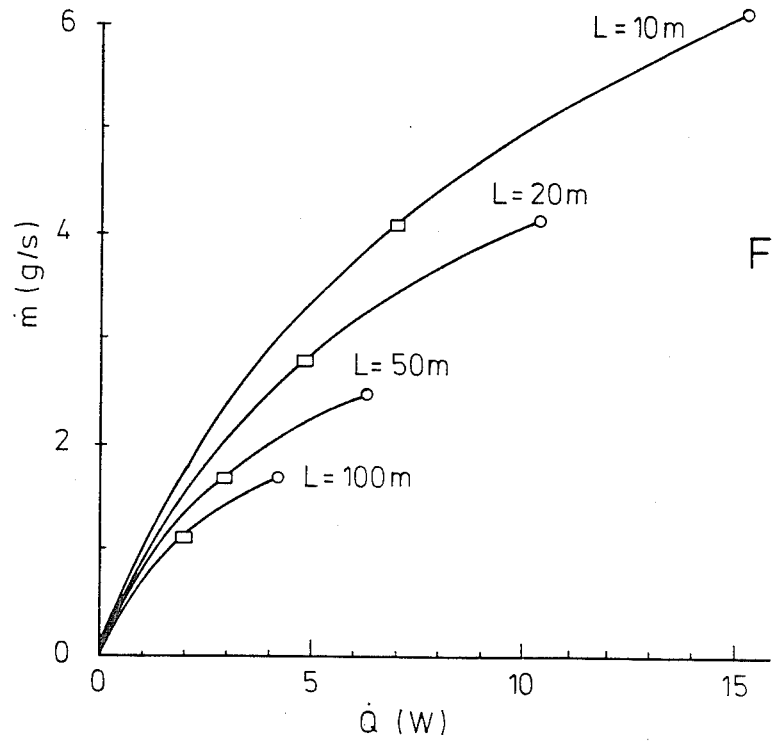
FIG. 2*a* shows the helium flow rate through different lengths of cooling channels having a diameter D = 4 mm as a function of the thermal load Q.

FIG. 2*a* shows the helium flow rate developed in channels having a diameter D=4 mm if heat stream Q is discharged therefrom. This shows that considerable heat loads can also be removed from long channels with the cooling system according to the invention. Cooling does not stop even if the exit temperature $T_2$ goes beyond the He II range.

Figure 2B:
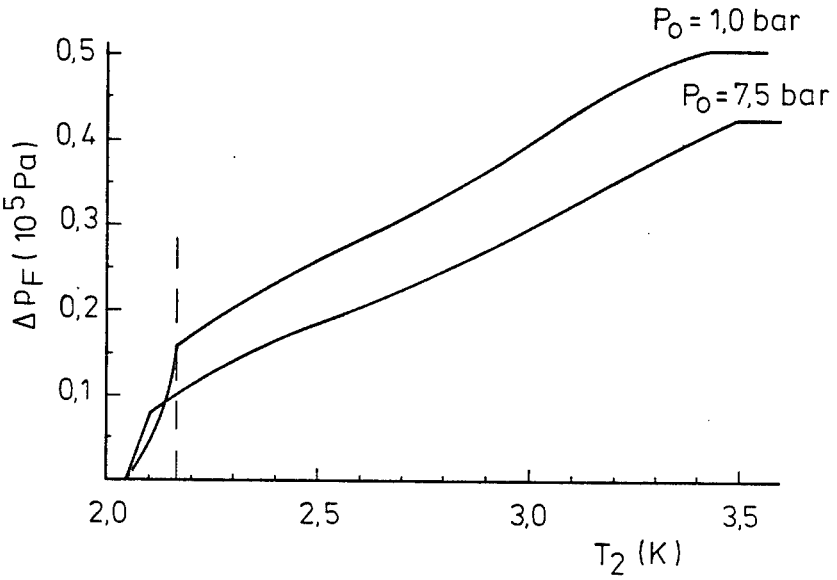
FIG. 2*b* shows the fountain effect pressure $\Delta p$ as a function of the exit temperature $T_2$.

As shown in FIG. 2*b*, the pumping pressure (fountain pressure $\Delta p_F$) even increases up to an exit temperature of $T_2^{max} \approx 3.5°$ K. Thus, it must be expected that in such a cooling system a continuous transition takes place from He II to forced He I cooling. This can also be considered an advantage over He II bath cooling.

Figure 3:
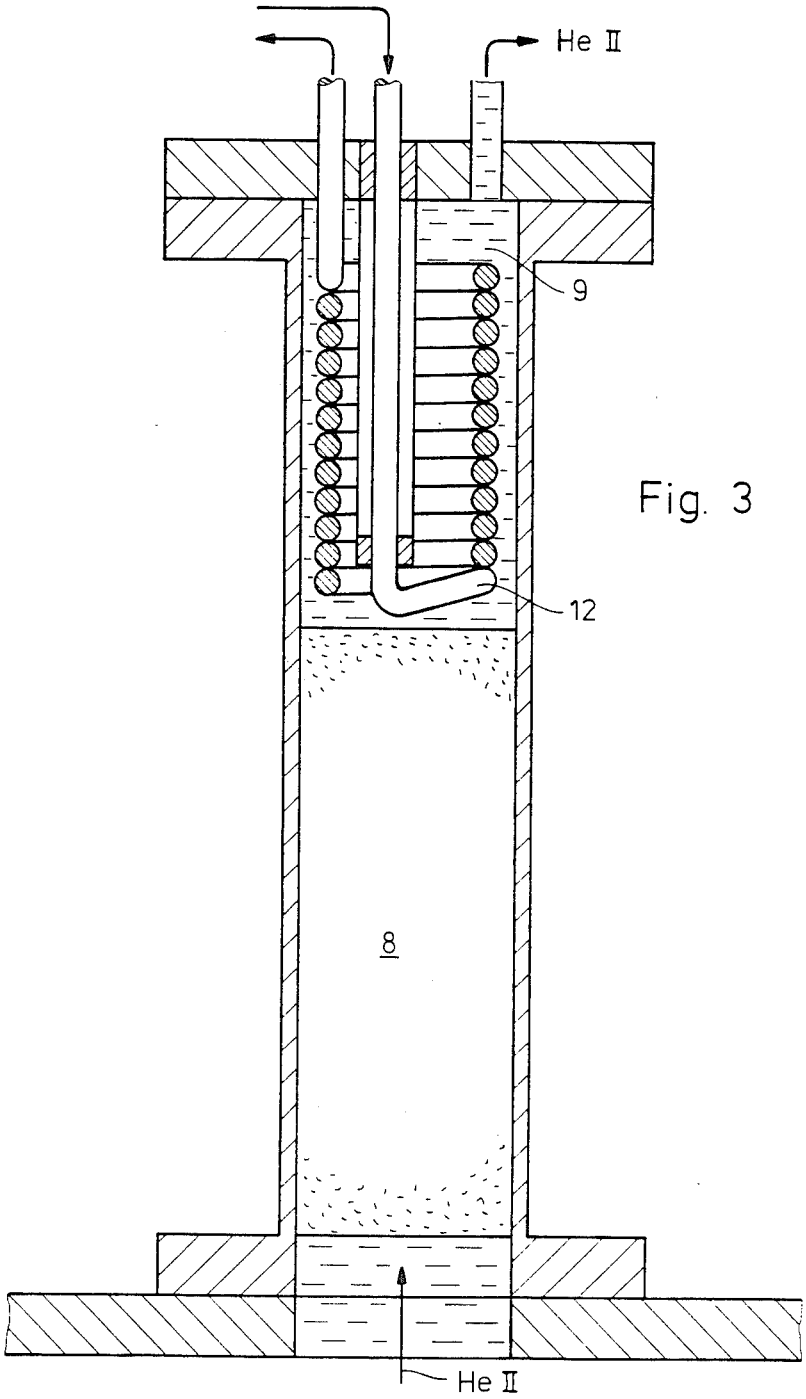
FIG. 3 shows an embodiment of a typical fountain effect pump.

FIG. 3 shows an embodiment of a typical fountain effect pump for a maximum pumping rate of about 10 g/sec with in a loop with small drop in pressure and for about 0.3 bar maximum pumping pressure at low flow rate. With such a unit it is possible, for example, to obtain about 3 watts of power from a cooling channel having a diameter of 5 mm and a length of 100 mm if the entrance temperature $T_1$ is 1.8° K. and the exit temperature $T_2$ is 2.16° K. Superfilter 8 here is composed, for example, of $Al_2O_3$ powder having an average particle size of 1.5 $\mu$m pressed to a fill factor of about 50% into a pipe having a length of approximately 100 mm and a diameter of 35 mm. However, other materials having a similar porosity can also be used. Cross-section and length of the filter units must be adapted to specific requirements for mass flow rate and pumping pressure.

To adapt such devices to the respective conditions regarding heat to be dissipated and cross-section as well as length of the cooling channels, a plurality of cooling channels 11 or a plurality of pumping units can be combined in a suitable manner.

When making such combinations, the fact must be considered that, due to physical effects, the pumping pressure that can be attained with such pumps is limited to relatively low values of less than about 0.5 bar. However, the attainable flow rate with a given filter material depends only on the amount of heat supplied and on the cross-section of the filter. Consequently, although it is impossible to operate cooling channels at any desired length, no physical limits exist with respect to subdividing them into a plurality of parallel channels.

Figure 4:
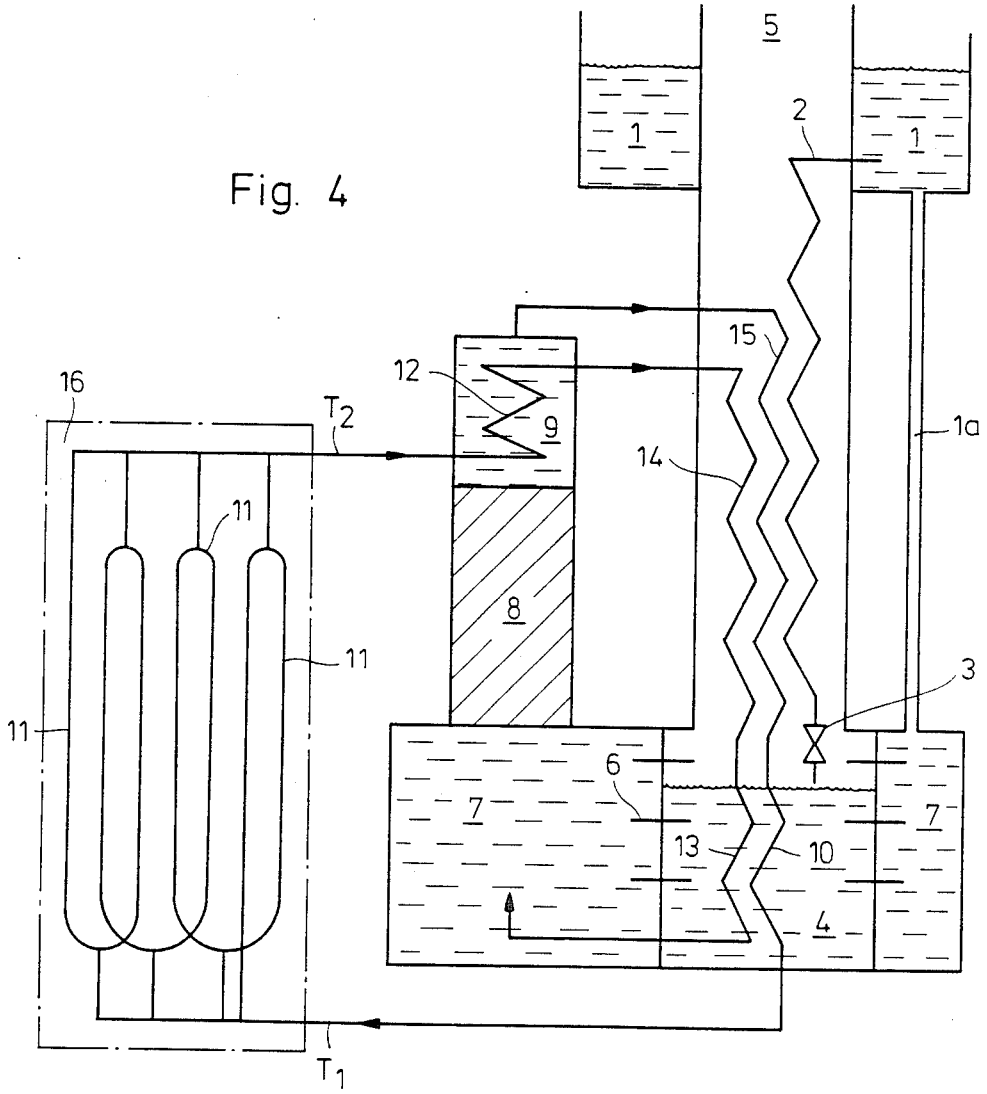
FIG. 4 is a schematic representation of a cooling system employing cooling channels connected in parallel.
Figure 5:
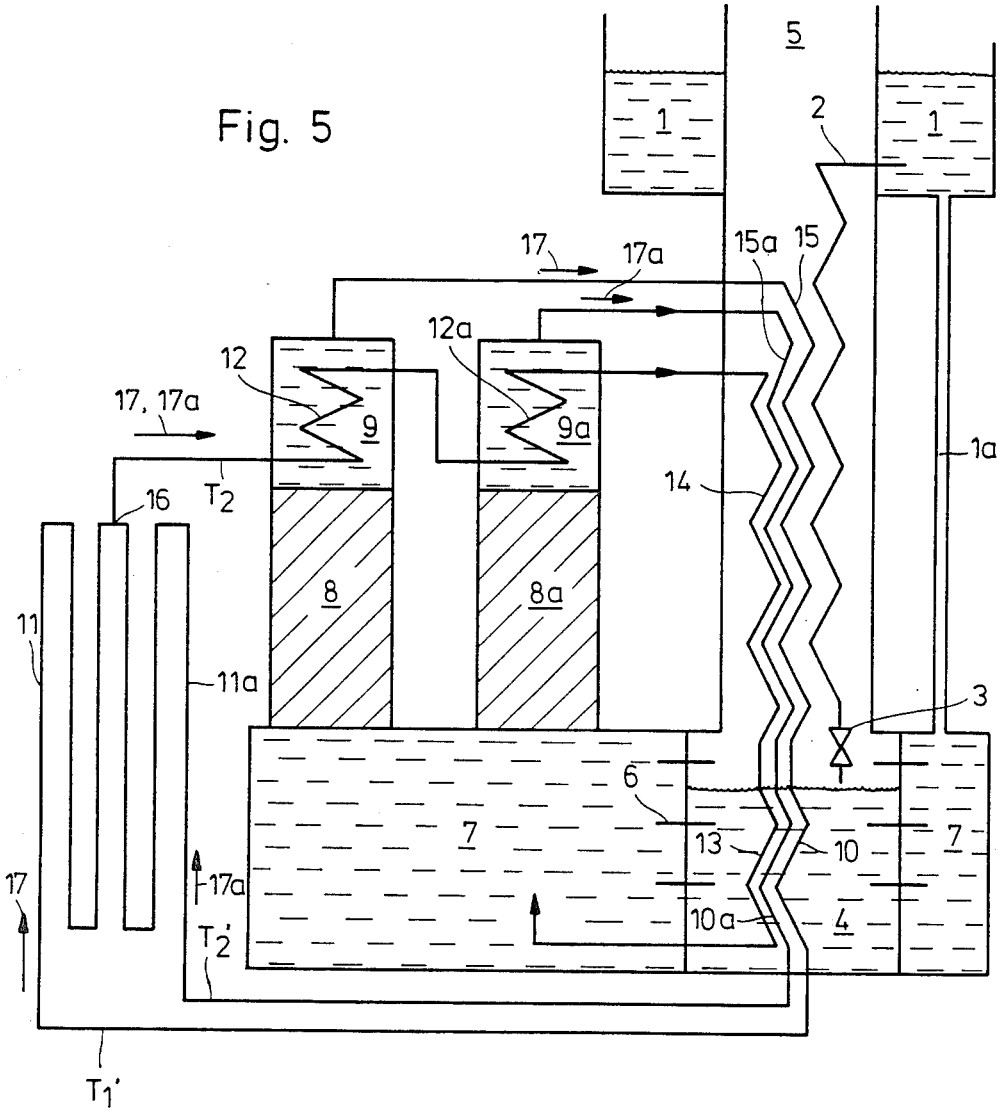
FIG. 5 is a schematic representation of a cooling system in the case where the parallel cooling channels 11, 11*a* have unequal loads.

FIG. 4 shows a cooling system having parallel connected cooling channels 11 as it is possible for a large heat load or narrow cooling channel cross-sections. This cooling system differs from the system shown in FIG. 1 only in that the He II stream is split into a plurality of partial streams in the object to be cooled (e.g. a superconductive coil). The cross-section of cooling channels 11 of superfilter 8 and heat-exchangers 10, 12, 13, 14 and 15 must be adapted here to the increase the flow rate. Such a system is advisable if all parallel branches have the same flow resistance and the same thermal loads.

FIG. 4 shows a cooling device suitable when parallel cooling channels 11 and 11*a* carry unequal loads. Each one of cooling channels 11 and 11*a* have their own pumps, thereby assuring that a flow rate corresponding to the respective load develops in each cooling channel 11 and 11*a*.

The heated He discharged from the center of coil 16 (or from any desired intermediate location) is initially conducted through the second heat-exchanger 12. It generates a first mass stream 17 which after being re-cooled in heat-exchangers 15 and 10 flows through cooling channel 11 of coil 16. After leaving heat-exchanger 12, the He is conducted into a sixth heat-exchanger 12*a* of a second fountain effect pump. Due to the already partially reduced temperature of the coolant at the time it enters this second pump, the second mass stream 17*a* generated there will be relatively smaller than the stream generated in the first pump. This helium stream is re-cooled in heat-exchangers 15*a* and 10*a* and then conducted through the second cooling channel 11*a* of coil 16.

Thus, a self-generated cooling system is attained wherein the coolant streams 17 and 17*a* which are different in both parts of the coil are generated. More than two parallel cooling circuits can also be set up according to the same principle.

Such cooling circuits with staggered cooling power may be of interest, in particular, for coils subjected to an inhomogeneous thermal load. Such a case exists, for example, for the toroidal field coil of a TOKAMAK fusion reactor. Due to the absorption of neutrons, the load is in this case considerably higher in the layers of the windings closest to the plasma than in areas further removed therefrom. In the cooling system shown in FIG. 5, the larger mass stream 17 is conducted through the inner windings.

Figure 6:
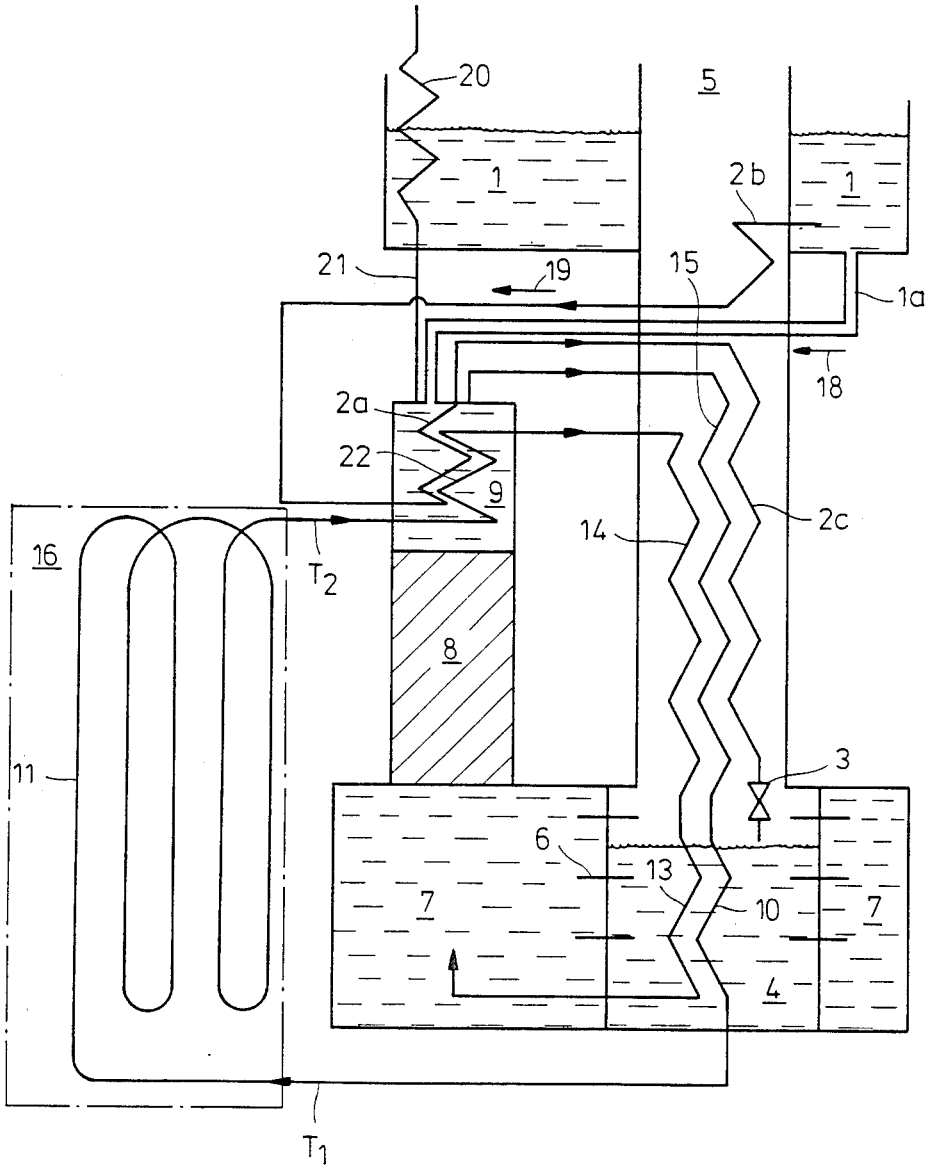
FIG. 6 shows a further cooling system design in which, in addition to the heat lost from the object being cooled, other heat sources are utilized to reinforce the forced flow.

FIG. 6 depicts a further cooling system wherein the He II is circulated as a result of the heat fed from the object being cooled back to the fountain effect pump. Additionally, the heat is also fed by other heat streams flowing at other locations in the entire cooling system between the temperature level of the He I reservoir vessel 1 and the He II heating bath 9.

In the particular embodiments discussed here, these are the following two parts:

(a) a first heat stream 18 is produced by the pressure equalization connection 1*a* between the He I system and the He II system and acts as a thermal barrier; and (b) a second heat stream 19 is produced as a result of the He flowing from the He I reservoir vessel 1 through an eighth heat exchanger 2*a* to the re-cooling bath 4.

Both heat streams, 18, and 19, are a load on heating bath 9 and thus contribute to its increased convection. These measures reduce the thermal load on the re-cooling bath 4. If a pressure conduit 21, thermally coupled via heat exchanger 20 with supply bath 1, is hydraulically decoupled from reservoir bath 1 instead of pressure equalization conduit 1*a*, any desired pressure can be imparted to the He II system 4 via this pressure conduit 21.

Figure 7:
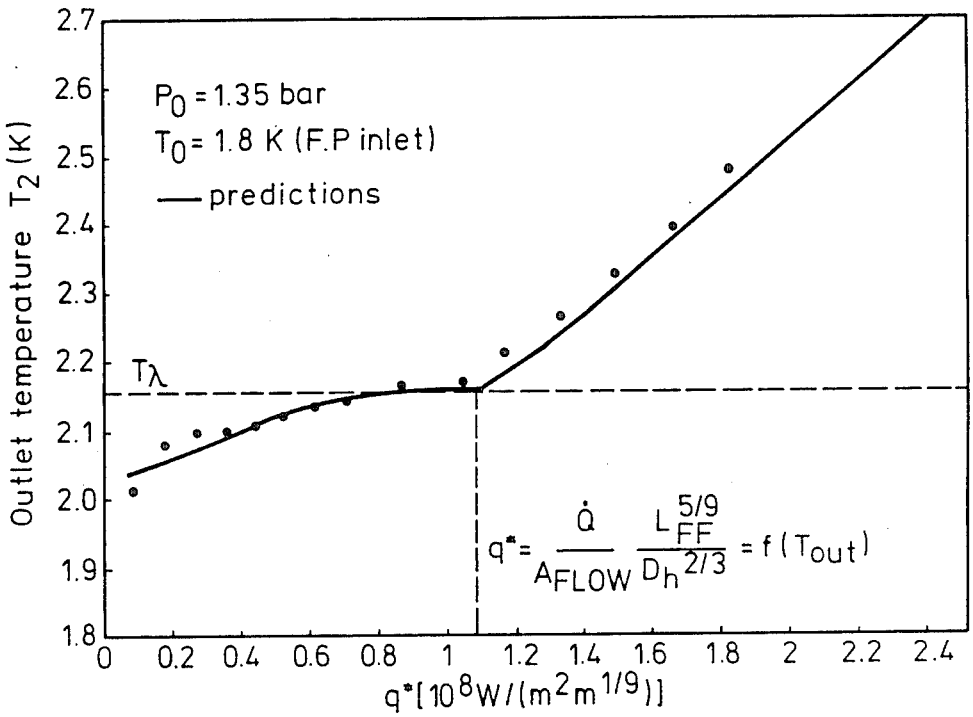
FIG. 7 illustrates the cooling characteristics of a fountain effect pump as shown in FIG. 3.

FIG. 7 illustrates the measured cooling characteristics of a fountain effect pump as shown in FIG. 3. The superfilter was made of $Al_2O_3$ powder with 1.5 $\mu$m mean grain size pressed into a tube of 35 mm inner diameter and 100 mm length. The helium was pumped through a heated loop with 3 mm inner diameter tubes of 7 m total length. The measured cooling characteristic, that is outlet temperature $T_2$ versus heat load Q times a geometric factor, $L^{5/9}/(FD^{\frac{2}{3}})$, where L is the length of the tubes, D its hydraulic diameter, and F its cross-sectional area, is illustrated in FIG. 7. The test results confirm the computed cooling characteristic. The helium flow rate in this loop ranged up to about 2 g/s when the system was charged with a thermal load of up to 6 W.

Having now generally described this invention, the same will be better understood in this reference to a certain specific example, which is included herein for purposes of illustration only and is not intended to be limiting of the invention or any embodiment thereof, unless so specified.

EXAMPLE

A cooling circuit according to FIG. 1 was constructed to include the fountain effect pump of FIG. 3, and the operating parameters, such as fluid temperature, pressure and mass flow were measured under various operating conditions.

A defined measuring path having a flow diameter of 3 mm and a length of 1 m was charged with a stream of heat Q=5.4 W. The fluid temperatures were measured at defined points in the circuit. The entrance temperature $T_1$ was 1.810° K. The exit temperature $T_2$, which is also the entrance temperature of the second heat exchanger (12), was 2.28° K. The fluid temperature at the outlet of the second heat exchanger (12) was 1.950° K. Also measured were the temperature at the inlet of the superfilter (8), which was 1.808° K. and the temperature at its outlet was 1.934° K. The pressure difference between inlet and outlet of superfilter 8 was 120 mbar. The mass flow dm/dt=2.3 g/s was measured in the cooling circuit by means of a flow meter.

With a heat load in the measuring path of Q=5.5 W, the flow resistance of the measuring path was increased by means of a choke, causing the mass flow dm/dt to go back to 1.7 g/s and the pressure difference between inlet and outlet of superfilter 8 to rise to 220 mbar.

The entrance temperature of measuring path $T_1$ was 1.810° K., the exit temperature $T_2$ was 2.6° K. The temperature at the inlet of superfilter (8) was measured to be 1.809° K. and the temperature at the outlet was 2.008° K.

These test results substantially confirm the theoretical predictions.

The present disclosure relates to the subject matter disclosed in FRG P. No. 35 29 391.8 filed on Aug. 16, 1985, the entire specification of which is incorporated herein by reference.

The invention now being fully described, it will be apparent to one of ordinary skill in the art, that many changes and modifications can be made thereto without departing from the spirit or scope of the invention as set forth herein.

What is claimed is:

1. A method of cooling a substrate, comprising steps for:

(a) cooling a substrate by contact with superfluid helium (He II) at a temperature betwen about 1.7° K. and 2.1° K. with a forced flow of He II to remove heat from the substrate and convert said Helium II to Helium I, and (b) utilizing thermal power obtained from the heat being removed from the substrate to force a current of superfluid helium (He II) through the substrate by means of a fountain effect pump.

2. The method of claim 1 further comprising re-cooling the superfluid helium leaving the substrate by transferring out of the outgoing helium flow the heat removed from the substrate, and incorporating the re-cooled helium into the forced flow of superfluid helium of step (a).

3. The method of claim 1 further comprising directing the forced superfluid helium II flow into a plurality of currents flowing separately within the substrate to be cooled.

4. The method of claim 3 further comprising combining the separate currents of superfluid helium (He II) subsequent to receiving the heat transferred from the substrate being cooled, and wherein the separate currents of superfluid helium (He II) are fed to the substrate by means of separate fountain effect pumps, and the heat removed from the substrate is transferred out of the outgoing helium flow by sequentially passing the outgoing helium flow through the separate fountain effect pumps, thereby re-cooling the helium.

5. The method of claim 1 wherein said thermal power is produced from cooling Helium I to Helium II, to further force a current of superfluid helium (He II) through the substrate by means of a fountain effect pump.

6. An apparatus for cooling a substrate which has a cooling conduit provided with an inlet and an outlet, comprising a means containing a closed He II circuit comprising first, second and third heat-exchangers being in flow communication with one another;

a housing containing a helium II heating bath of a fountain effect pump, a housing containing a helium II re-cooling bath having an inlet, a vessel containing helium, a pressure equalizing conduit, a housing containing a helium II supply bath, and a superfilter of a fountain effect pump;

said first heat-exchanger being positioned in the re-cooling bath and connected to the inlet of the cooling conduit of the substrate to be cooled;

said second heat-exchanger being positioned in the heating bath of the fountain effect pump and having its inlet connected to an outlet of the cooling conduit of the substrate to be cooled.

said third heat-exchanger being positioned in the re-cooling bath and having an inlet of said third heat-exchanger connected to an outlet of the second heat-exchanger and an outlet of said third heat-exchanger opened up into the supply bath which is in flow communication with, and supplies helium II to, said superfilter of the fountain effect pump; and said vessel containing helium and said helium supply bath being in flow communication with one another by means of the pressure equalizing conduit.

7. The apparatus of claim 6 further comprising a fourth heat-exchanger positioned between the second heat-exchanger and the third heat-exchanger, wherein the outlet of the second heat-exchanger is connected to an inlet of the fourth heat-exchanger and an outlet of the fourth heat-exchanger is connected to the inlet of the third heat-exchanger; said fourth heat-exchanger being in heat exchange with an exhaust space above the re-cooling bath.

8. The apparatus of claim 6 further comprising a fifth heat-exchanger positioned between the heating bath of the fountain effect pump and the first heat-exchanger; said fifth heat exchanger being in heat exchange with an exhaust space above the re-cooling bath.

9. The apparatus of claim 6 further comprising a sixth heat-exchanger, and a pressure reduction valve;

said sixth heat exchanger positioned inside the heating bath of the fountain effect pump and being thermally coupled to the vessel;

an inlet of the sixth heat-exchanger being connected to the vessel and an outlet of the sixth heat-exchanger opening into the re-cooling bath through the pressure reduction valve.

10. The apparatus of claim 6 wherein the pressure equalizing conduit places the vessel containing helium and the heating bath in flow communication.

11. The apparatus of claim 6 further comprising a seventh heat-exchanger positioned within the vessel containing helium; said seventh heat-exchanger opening into the heating bath by means of a second pressure equalizing conduit.

* * * * *